US010156060B2

(12) United States Patent
Yamashita et al.

(10) Patent No.: US 10,156,060 B2
(45) Date of Patent: Dec. 18, 2018

(54) ROTATION DRIVE APPARATUS FOR CONSTRUCTION MACHINE

(71) Applicant: KOBELCO CONSTRUCTION MACHINERY CO., LTD., Hiroshima-shi (JP)

(72) Inventors: Koji Yamashita, Hiroshima (JP); Takayuki Doi, Hiroshima (JP)

(73) Assignee: KOBELCO CONSTRUCTION MACHINERY CO., LTD., Hiroshima-shi (JP)

( * ) Notice: Subject to any disclaimer, the term of this patent is extended or adjusted under 35 U.S.C. 154(b) by 133 days.

(21) Appl. No.: 15/128,011

(22) PCT Filed: Mar. 19, 2015

(86) PCT No.: PCT/JP2015/058298
§ 371 (c)(1),
(2) Date: Sep. 21, 2016

(87) PCT Pub. No.: WO2015/151841
PCT Pub. Date: Oct. 8, 2015

(65) Prior Publication Data

US 2017/0107690 A1 Apr. 20, 2017

(30) Foreign Application Priority Data

Mar. 31, 2014 (JP) ..... 2014-070907

(51) Int. Cl.
*E02F 9/12* (2006.01)
*E02F 9/26* (2006.01)
(Continued)

(52) U.S. Cl.
CPC ..... *E02F 9/123* (2013.01); *B66C 23/84* (2013.01); *E02F 9/128* (2013.01); *E02F 9/24* (2013.01); *E02F 9/268* (2013.01)

(58) Field of Classification Search
None
See application file for complete search history.

(56) References Cited

U.S. PATENT DOCUMENTS 4,232,768 A * 11/1980 Dufresne ..... B66D 5/08 188/106 P
2007/0273316 A1* 11/2007 Yoshimatsu ..... E02F 9/121 318/371

(Continued)

FOREIGN PATENT DOCUMENTS

CN 103215982 A 7/2013
CN 103502540 A 1/2014

(Continued)

OTHER PUBLICATIONS

Hori; Machine Translation of JPH11300565A; Nov. 1999; espacenet.com (Year: 1999).*

(Continued)

*Primary Examiner* — David P. Merlino
(74) *Attorney, Agent, or Firm* — Oblon, McClelland, Maier & Neustadt, L.L.P.

(57) ABSTRACT

A rotation drive apparatus for rotating an upper rotary body of a construction machine, the rotation drive apparatus eliminating, while achieving a fundamental goal of stopping a rotation when an emergency stop operation is performed, wasteful stopping by a parking brake. The apparatus includes: an emergency stop switch; a rotation control section which performs control to stop a rotating motor when the emergency stop operation is applied to the emergency stop switch; and a timer which activates the parking brake when a set period of time has elapsed after the emergency stop operation is performed. Preferably, the rotation control section detects a failure of an inverter and causes the parking brake to perform a braking operation before the elapse of the set period of time when the failure is detected.

4 Claims, 5 Drawing Sheets

(51) Int. Cl.
*B66C 23/84* (2006.01)
*E02F 9/24* (2006.01)

(56) References Cited

U.S. PATENT DOCUMENTS

| | | | | |
|---|---|---|---|---|
| 2013/0221888 | A1* | 8/2013 | Horikoshi | H02P 27/06 318/400.29 |
| 2013/0243557 | A1* | 9/2013 | Hiroki | E02F 9/128 414/687 |
| 2013/0284532 | A1 | 10/2013 | McVey et al. | |
| 2014/0013752 | A1 | 1/2014 | Komiyama et al. | |
| 2014/0145657 | A1 | 5/2014 | Takeo | |
| 2014/0323268 | A1* | 10/2014 | Ishikawa | E02F 9/128 477/52 |
| 2014/0354197 | A1* | 12/2014 | Ito | H02P 29/027 318/366 |
| 2015/0042259 | A1* | 2/2015 | Kim | E02F 9/128 318/703 |

FOREIGN PATENT DOCUMENTS

| | | | | |
|---|---|---|---|---|
| EP | 2 626 474 | A1 | 8/2013 | |
| JP | H11300565 | A * | 11/1999 | |
| JP | 2007-204924 | A | 8/2007 | |
| JP | 2009-155988 | A | 7/2009 | |
| JP | 2011-6862 | A | 1/2011 | |
| JP | 2012-82607 | A | 4/2012 | |
| JP | 2012-241338 | A | 12/2012 | |
| JP | 2013-133622 | A | 7/2013 | |
| WO | WO 2013/021978 | A1 | 2/2013 | |
| WO | WO-2013060010 | A1 * | 5/2013 | E02F 9/2083 |

OTHER PUBLICATIONS

International Search Report dated Jun. 9, 2015, in PCT/JP2015/058298 filed Mar. 19, 2015.
Extended European Search Report dated Mar. 2, 2017 in Patent Application No. 15773784.2.
Japanese Office Action dated Aug. 15, 2017 in Patent Application No. 2014-070907 (with English translation).

* cited by examiner

ROTATION DRIVE APPARATUS FOR CONSTRUCTION MACHINE

TECHNICAL FIELD

The present invention relates to a rotation drive apparatus including an electric motor for rotationally driving an upper rotary body of a construction machine.

BACKGROUND ART

There is known a rotation drive apparatus which is provided in a construction machine such as an excavator and includes an electric motor (rotation motor) for rotating an upper rotary body of the construction machine. Furthermore, there is also known a type that includes a parking brake which operates, when the upper rotary body is in a rotation stopped state, to hold the upper rotary body in the stopped state (see Patent Literature 1).

Such construction machines include one having a function to activate the parking brake to stop a rotation when an operator or the like applies an emergency stop operation to a switch or the like. However, in this type of construction machine, the parking brake is activated to stop the rotation also when the emergency stop operation is performed in spite of no rotation failure condition, for example, when an operation by an operator based on an erroneous failure judgement, or owing to misrecognition or accidental contact, or an experimental operation by an operator or a worker other than the operator, is performed. This uselessly increases the activation frequency of the parking brake. Furthermore, the parking brake, which is originally designed with an assumption that it operates under a rotation stopped condition, gets greatly damaged when activated for stopping during a rotation. The above-described wasteful rotation stopping action, thus, accelerates damage to the parking brake; this may prevent the parking brake from fulfilling its original stop holding function or reduce the lifetime of the parking brake.

CITATION LIST

Patent Literature

Patent Literature Japanese Unexamined Patent Publication No. 2013-133622

SUMMARY OF INVENTION

It is an object of the present invention to provide a rotation drive apparatus for rotating an upper rotary body of a construction machine, the rotation drive apparatus being capable of eliminating, while keeping a fundamental rule of stopping a rotation of the upper rotary body when an emergency stop operation is performed, wasteful stopping to thereby reduce the activation frequency of a parking brake for holding the stopped state. Provided is a rotation drive apparatus equipped in a construction machine including a lower travelling body and an upper rotary body rotatably mounted on the lower travelling body to rotate the upper rotary body, comprising: a rotating motor which is a rotation drive source for the upper rotary body; a rotation operation device including an operation member which receives an operation to instruct a rotational movement of the upper rotary body, the rotation operation device being configured to output a rotation operation signal according to the operation received by the operation member; a parking brake switchable between a brake activation state of applying a mechanical braking force to the upper rotary body and a brake release state of releasing the braking force; a brake valve operable to switch the parking brake between the brake activation state and the brake release state; an emergency stop switch which outputs an emergency stop command signal to execute an emergency stopping of the rotational movement when receiving an operation from an operator; a rotation control section which receives the rotation operation signal output by the rotation operation device and the emergency stop command signal output by the emergency stop switch, and controls the rotational movement of the upper rotary body based on the received signal; and a timer device which brings the parking brake into braking operation when a set period of time has elapsed after the emergency stop switch outputs the emergency stop command signal. The rotation control section performs inputting one of acceleration, deceleration, and stop commands to the rotating motor based on the rotation operation signal, inputting a brake activation command to the brake valve when the operation member of the rotation operation device is at a neutral position and the rotation of the upper rotary body is kept be stopped, inputting a brake release command to the brake valve when the operation member of the rotation operation device is at a position shifted from the neutral position, and inputting the stop command to stop the rotating motor to the rotating motor when receiving the emergency stop command signal.

DESCRIPTION OF EMBODIMENTS

Figure 5:
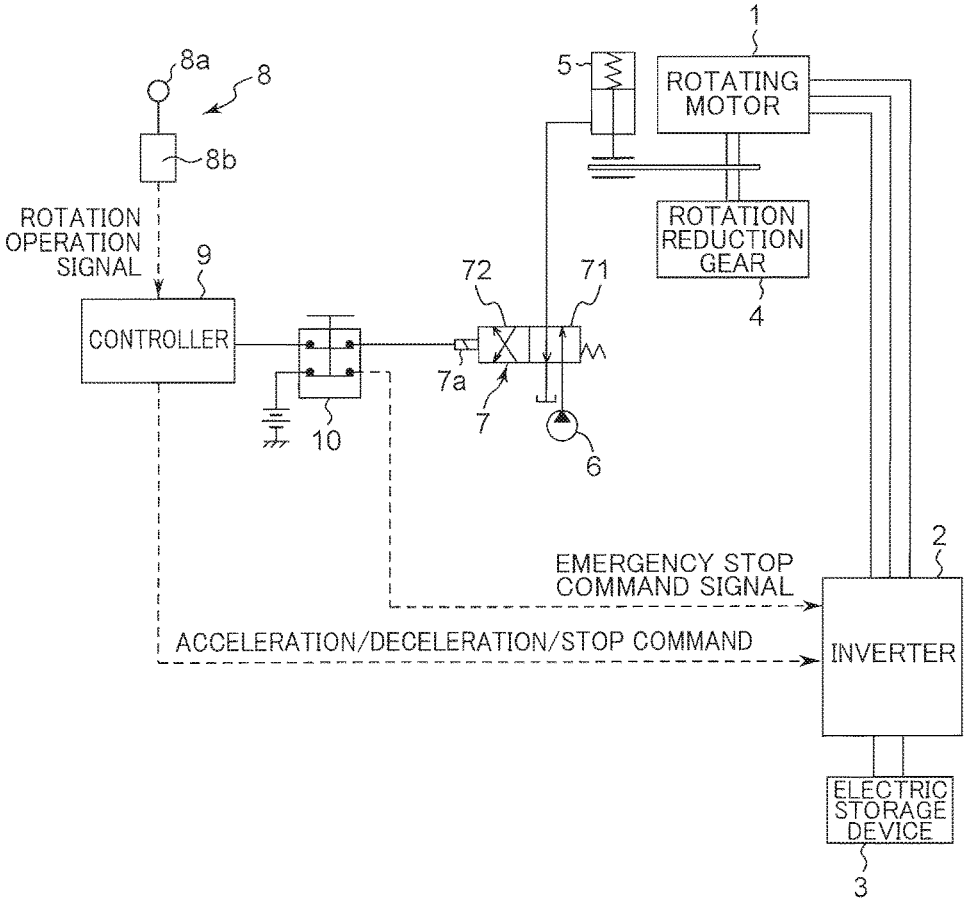
FIG. 5 is a system configuration diagram showing a rotation drive apparatus according to a comparative example.

In advance of describing embodiments of the present invention, will be described a rotation drive apparatus according to a comparative example shown in FIG. 5. The comparative example is prepared for explaining the embodiments of the present invention.

The rotation drive apparatus according to the comparative example is equipped in a construction machine including a lower travelling body and an upper rotary body rotatably mounted on the lower travelling body to rotate the upper rotary body. The rotation drive apparatus includes a rotating motor 1 which is a rotation drive source for the upper rotary body, an inverter 2 which is a part of a rotation control section, and an electric storage device 3 connected to the rotating motor 1 via the inverter 2. The rotating motor 1 is driven by electric power stored in the electric storage device 3. In the case of a hybrid construction machine, a generator or a generator motor driven by an engine also can serve as an electric power source.

The rotation drive apparatus further includes a rotation reduction gear 4 and a parking brake (also referred to as "mechanical brake") 5. The rotation reduction gear 4 is connected to the rotating motor 1 so as to be able to reduce the rotation speed of the rotating motor 1. The parking brake 5 is in the form of a hydraulic brake which applies a mechanical braking force to the upper rotary body.

The parking brake 5 is a negative brake which exerts a braking force owing to a spring force when no hydraulic pressure is applied thereto and releases the braking force when a hydraulic pressure is applied thereto. When the braking force is released, rotational movements, i.e., an acceleration including activation and a deceleration, of the upper rotary body are performed.

The apparatus further includes a brake operation section which operates the parking brake 5. The brake operation section includes a hydraulic pump 6 serving as a hydraulic source driven by a not-graphically-shown engine, and a brake valve 7 having a brake activation position 71 and a brake release position 72. The brake valve 7 is formed of an electromagnetic selector valve including a solenoid 7*a*. The brake valve 7, when switched to the brake activation position 71, lets the hydraulic pressure from the parking brake 5 to a tank T to bring the parking brake 5 into braking action. The brake valve 7, when switched to the brake release position 72, allows the hydraulic pressure to be supplied to the parking brake 5 to release the braking force of the parking brake 5.

The rotation drive apparatus further includes a rotation operation device 8 and a controller 9. The rotation operation device 8 includes a rotation operation lever 8*a* which receives an operation by an operator and an operation device body 8*b* which produces an output of a rotation operation signal which is an electrical signal corresponding to the presence/absence, the direction, and the amount of a lever operation applied to the rotation operation lever 8*a*. The controller 9 receives the rotation operation signal and inputs a command for acceleration including activation, deceleration or stop to the inverter 2, based on the rotation operation signal. The inverter 2 inputs an operation command to the rotating motor 1 based on the inputted command. The inverter 2 and the controller 9, thus, constitute a rotation control section which controls a rotational movement of the upper rotary body.

Besides, to the solenoid 7*a* of the brake valve 7, the controller 9 inputs a brake release command when the rotation operation lever 8*a* is shifted from a neutral position to another position and a brake activation command when the rotation operation lever 8*a* receives no operation to be kept at the neutral position. In this manner, the controller 9, when a lever operation is applied to the rotation operation lever 8*a*, brings the parking brake 5 into the brake release state and accelerates, decelerates, or stops the rotating motor 1 by a command according to the lever operation and, when no operation is applied to the rotation operation lever 8*a* to keep it at the neutral position, brings the parking brake 5 into the braking operation to keep the rotating motor 1 and the upper rotary body be stopped.

The rotation drive apparatus further includes an emergency stop switch 10 to which an emergency stop operation is applied by an operator feeling a rotational movement failure. The emergency stop switch 10 is disposed between the controller 9 and the solenoid 7*a* of the brake valve 7. When receiving the emergency stop operation, the emergency stop switch 10 outputs an emergency stop command signal and blocks an input of a command from the controller 9 to the solenoid 7*a* to thereby switch the brake valve 7 to the brake activation position 71 to bring the parking brake 5 into the braking action, thus stopping the rotational movement of the upper rotary body. Furthermore, the emergency stop command signal is input to the inverter 2 to thereby power off the inverter 2 to stop the motor control by the inverter 2.

The rotation drive apparatus according to the comparative example is so designed as to stop a rotation by activation of the parking brake 5 whenever the emergency stop operation is performed, based on an assumption that a rotation failure is caused by a circuit failure, in particular, a failure of the inverter 2; therefore, the parking brake 5 can be activated also by a so-called erroneous operation in which the emergency stop operation is applied to the emergency stop switch 10 in spite of no rotation failure, such as an operation based on an erroneous failure judgement by an operator, an operation owing to misrecognition of, or accidental contact with, a wrong switch, or an experimental operation by an operator or a worker other than the operator. Such wasteful brake activation in response to an erroneous operation uselessly increases the activation frequency of the parking brake 5. Furthermore, the parking brake 5, which is originally designed with an assumption that it operates in the rotation stopped state, gets greatly damaged when operated during a rotation. The parking brake 5 is thus easily damaged, which may disable the parking brake 5 from performing the primary stop holding function or may reduce its lifetime.

Rotation drive devices according to first to third embodiments shown in FIGS. 1 to 4 solve the above problems.

Respective devices according to the embodiments share the following configuration. Each device is configured to rotationally drive an upper rotary body of a construction machine including a lower travelling body and the upper rotary body rotatably mounted on the lower travelling body, including, a similarly to the apparatus of the comparative example, a rotating motor 11 which is a drive source for the rotational driving, an inverter 12, an electric storage device 13 which is connected to the rotating motor 1 via the inverter 12 and stores electric power to be used to drive the rotating motor 11 (in the case of a hybrid construction machine, in cooperation with electric power from a generator or a generator motor), a rotation reduction gear 14 connected to the rotating motor 1 so as to be able to reduce the rotation speed of the rotating motor 1, and a hydraulic parking brake (also referred to as "mechanical brake") 15 connected to the rotating motor 11 so as to be able to apply a mechanical braking force to the upper rotary body.

The parking brake 15, which is a negative brake to exert a braking force owing to a spring force when no hydraulic pressure is applied thereto, is switched to the brake release state of releasing the braking force by a supply of an hydraulic pressure. A rotational movement, i.e., an acceleration including activation or a deceleration, is performed when the parking brake 15 is in the brake release state.

The apparatus according to each embodiment includes a brake operation section which operates the parking brake 15. The brake operation section includes a hydraulic pump 16 which is a hydraulic source driven by a not-graphically-shown engine, and a brake valve 17 switchable between a brake activation position 17*b* and a brake release position 17*c*. The brake valve 17 is formed of an electromagnetic selector valve including a solenoid 17*a*. When switched to the brake activation position 17*b*, the brake valve 17 lets the hydraulic pressure from the parking brake 15 to a tank T to bring the parking brake 15 into braking operation. When switched to the brake release position 17*c*, the brake valve 17 allows hydraulic pressure to be supplied to the parking brake 15 to release the braking force of the parking brake 15.

The rotation drive apparatus according to each embodiment further includes a rotation operation device 18 and a controller 19. The rotation operation device 18 includes a rotation operation lever 18*a* which is an operation member to receive an operation by an operator and an operation device body 18*b* which produces an output of a rotation operation signal which is an electrical signal corresponding to the presence/absence, the direction, and the amount of a lever operation applied to the rotation operation lever 18*a*.

To the solenoid 17*a* of the brake valve 17, the controller 19 inputs a brake release command when the rotation operation lever 18*a* is shifted from a neutral position to another position and inputs a brake activation command when the rotation operation lever 18*a* is at the neutral position without receiving any operation. Thus, the controller 19, when a lever operation is applied to the rotation operation lever 18*a*, brings the parking brake 15 into the brake release state, and inputs to the inverter 12 a command corresponding to the operation to thereby accelerate, decelerate, or stop the rotating motor 11 and, when no operation is applied to the rotation operation lever 18*a* to keep it at the neutral position, brings the parking brake 15 into the braking operation to keep the rotating motor 11 and the upper rotary body be stopped, provided that the rotation is being stopped. The inverter 12 and the controller 19 thus constitute a rotation control section which controls a rotational movement of the upper rotary body.

Furthermore, the rotation drive apparatus according to each embodiment includes an emergency stop switch 20 to which an operation is applied by an operator feeling a rotational movement failure, and an off-delay timer relay 21 forming a timer.

Next will be described each embodiment.

Figure 1:
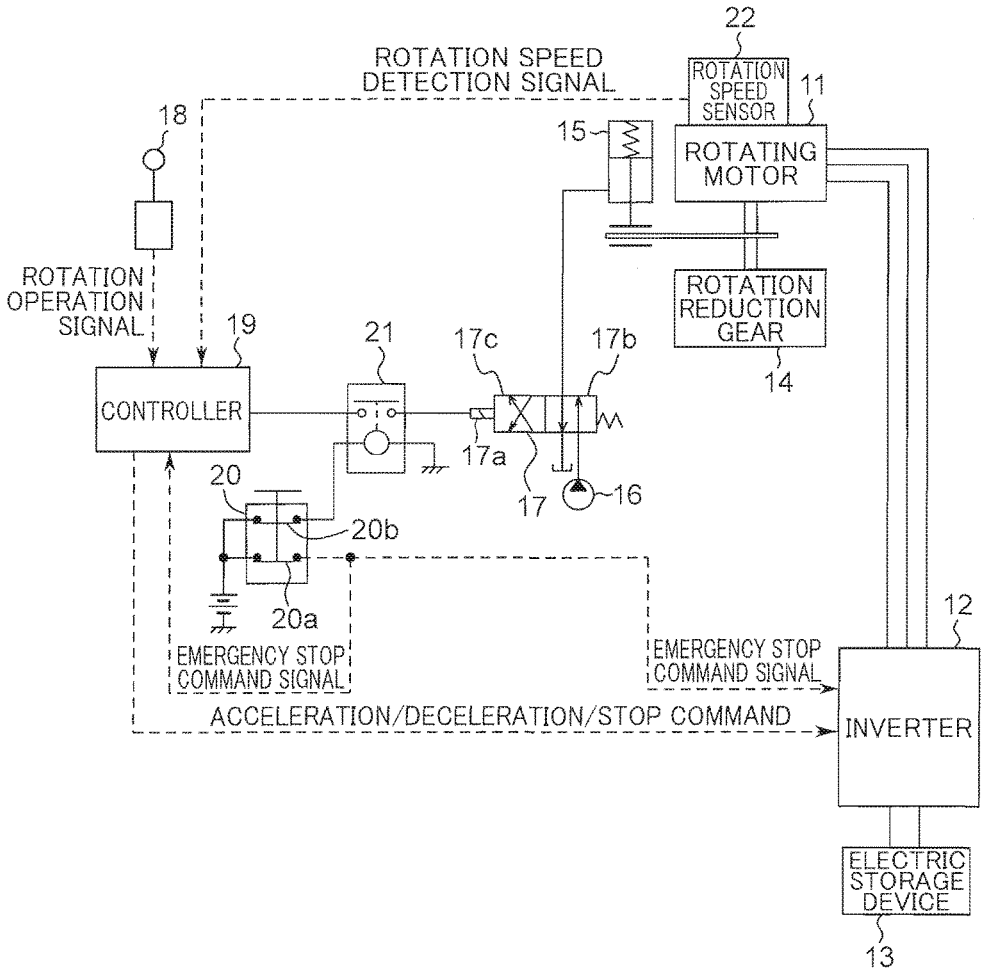
FIG. 1 is a system configuration diagram showing a rotation drive apparatus according to a first embodiment of the present invention.
Figure 2:
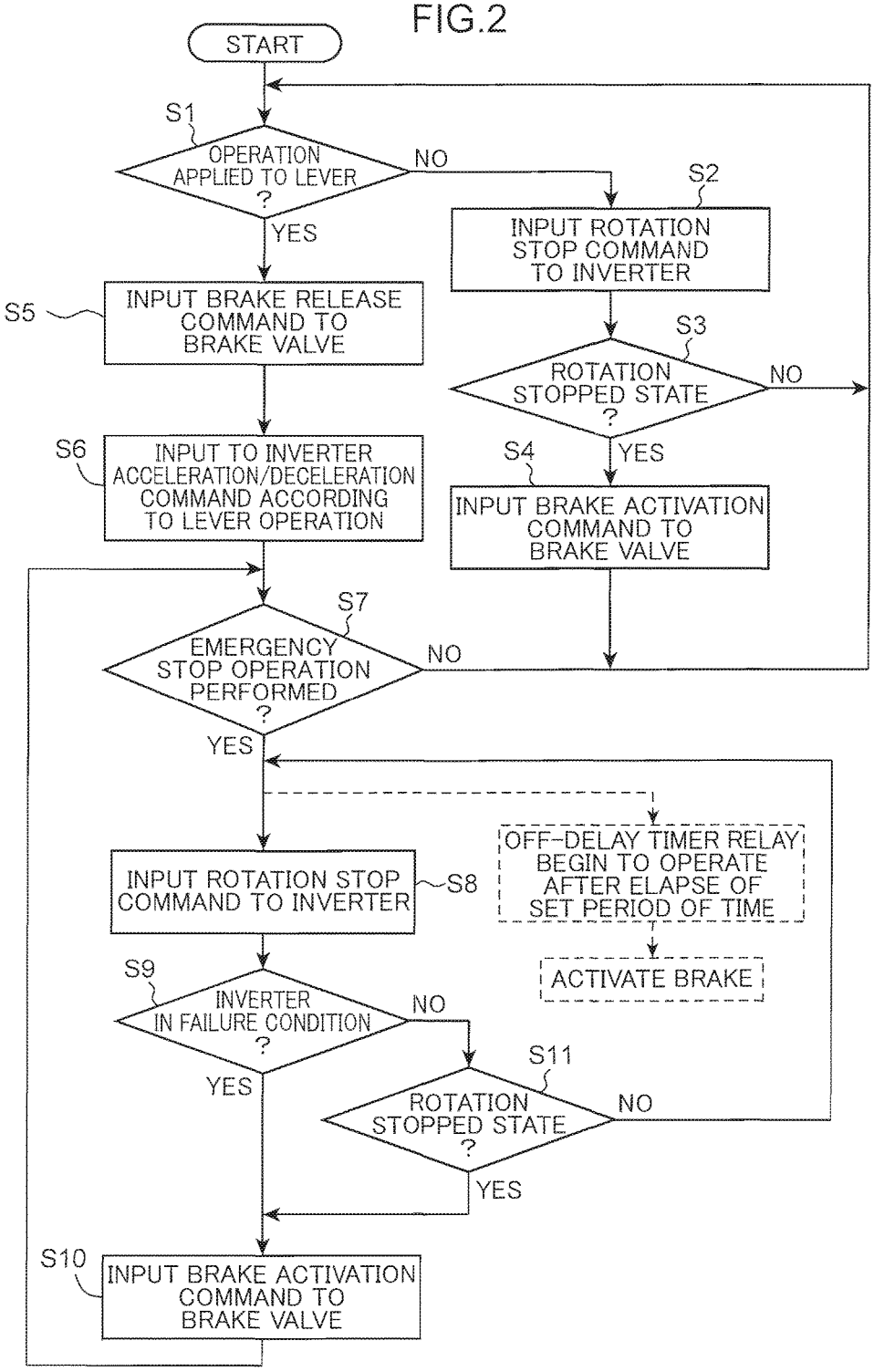
FIG. 2 is a flowchart illustrating a control operation performed by a controller in the rotation drive apparatus.

FIGS. 1 and 2 show a rotation drive apparatus according to a first embodiment. The emergency stop switch 20 according to the first embodiment includes first and second contacts 20*a* and 20*b* each being a normally closed contact opened only when the emergency stop operation is applied to the emergency stop switch 20. To the first contact 20*a* is connected the controller 19 and the inverter 12. To the second contact 20*b* is connected a coil 21*a* of the off-delay timer relay 21.

The off-delay timer relay 21 includes a relay contact 21*b* which opens when a preset period of time has elapsed after an operation is applied to the emergency stop switch 20. The relay contact 21*b* is interposed between the controller 19 and the solenoid 17*a* of the brake valve 17. Therefore, when the relay contact 21*b* is opened, the off-delay timer relay 21 cuts off power supply from the controller 19 to the solenoid 17*a* of the brake valve 17 to block an input of the brake release command to the solenoid 17*a*. This switches the brake valve 17 from the brake release position 17*c* to the brake activation position 17*b* to activate the parking brake 15. Therefore, the emergency stop switch 20, when receiving an operation by an operator, inputs respective emergency stop signals simultaneously to the controller 19 and the inverter 12 and, after the elapse of the set period of time, the off-delay timer relay 21 brings the parking brake 15 into the braking operation.

The controller 19, while performing the above-described regular control, i.e., the control of the rotating motor 11 and the parking brake 15 according to a lever operation applied to the rotation operation lever 18*a* of the rotation operation device 18, produces an input of a rotation stop command of stopping the rotating motor 11 to the inverter 12, when receiving the emergency stop signal from the emergency stop switch 20 to which the emergency stop operation is applied.

The rotation drive apparatus further includes a rotation speed sensor 22, which is a rotation detection device for detecting a rotation speed of the rotating signal related to the rotation speed and inputs it to the controller 19. The controller 19 performs the following operations based on the rotation speed detection signal.

(A) As the regular control, the controller 19 judges, based on the rotation speed detection signal, whether the construction machine is in the rotation stopped state where the rotation of the upper rotary body is stopped, and inputs the brake activation command to the solenoid 17*a* of the brake valve 7 at a point in time when confirming the rotation stopped state.

(B) When the emergency stop operation is applied to the emergency stop switch 20, the controller 19 judges whether the rotation speed of the rotating motor 11 is being decreased based on the rotation speed detection signal. In the case of decrease, the controller 19 makes no particular action based on the judgement that the inverter 12 is normally operating, that is, not being in a failure condition. In the case of no decrease, the controller 19 inputs the brake stop command to the solenoid 17*a* based on the judgement that the inverter 12 is in the failure condition. The controller 19, thus, includes a failure judgement section which judges whether the inverter 12 is in the failure condition and constitutes a failure detection section in cooperation with the rotation speed sensor 22 as the rotation speed detection device, and an emergency stop section which brings the parking brake 15 into the braking operation regardless of the activation of the timer 21, i.e., regardless of the elapse of the set period of time after the emergency stop switch 20 outputs the emergency stop command signal, when the inverter 12 is detected as being in the failure condition.

The sequence of the control operation performed by the controller 19 is explained with reference to the flowchart shown in FIG. 2.

The controller 19 initially performs the regular control. The controller 19, specifically, judges whether a lever operation is applied to the rotation operation lever 18*a* at step S1. When judging that no operation is applied (NO at step S1), the controller 19 inputs the rotation stop command to the inverter 12 at step S2. Upon the input, the inverter 12 decelerates and stops the rotating motor 11, thereby stopping the rotation of the upper rotary body.

In the next step S3, the controller 19 judges whether the construction machine is in the rotation stopped state, based on a rotation speed detection signal. When judging that the rotation has not been yet stopped (NO at step S3), the controller 19 repeats the operations from step S1. When judging that the construction machine is in the rotation stopped state (YES at step S3), the controller 19 inputs the brake activation command to the solenoid 17*a* of the brake valve 17 at step S4, and then repeats the operations from step S1. The brake activation command activates the parking brake 15 to keep the upper rotary body be stopped.

On the other hand, when judging that a lever operation is applied to the rotation operation lever 18*a* at step S1 (YES at step S1), the controller 19 inputs the brake release command to the solenoid 17*a* of the brake valve 17 at step S5, and inputs to the inverter 12 the acceleration or deceleration command according to the lever operation at step S6. Subsequently, at step S7, the controller 19 judges whether the emergency stop operation is performed, and when judging that emergency stop operation is not performed (NO at step S7), the controller 19 repeats the operations from step S1, and, when judging that the emergency stop operation is performed (YES at step S7), the controller proceeds to step S8.

The controller 19 inputs the rotation stop command to the inverter 12 at step S8 and, at step S9, confirms whether the rotation of the upper rotary body is being decelerated in response thereto based on a rotation speed detection signal, and judges, based on the result, whether the inverter 12 is in the failure condition. If non-decelerated condition, the controller 19 judges that the inverter 12 is in the failure condition (YES at step S9), and inputs the brake activation command to the brake valve 17 at once, at step S10, to bring the parking brake 15 into the braking action to thereby stop the rotation. If decelerated condition, the controller 19 judges that the inverter 12 is in a normal condition (NO at step S11), and proceeds to step S11 to determine whether the rotation has been stopped as a result of the rotation stop command which is judged as being presence at step S7. When the rotation has not been yet stopped (NO at step S11), the controller 19 repeats the operations from step S8. When judging that the rotation has been stopped (YES at step S11), the controller 19 inputs the brake activation command to the brake valve 17 at step S10 and then repeats the operations from step S7.

Independently of the control performed by the controller 19, the off-delay timer 21 begins to operate when the set period of time has elapsed after the emergency stop operation is performed, whether the inverter 12 is in the failure condition and whether the controller 19 inputs the brake stop command to the brake valve 17, as indicated by the dashed line in FIG. 2, to bring the parking brake 15 into the braking action.

This device, in which the controller 19 is configured not to activate the parking brake 15 in direct response to the emergency stop operation as in the comparative example but to try a rotation stopping by provision of the rotation stop command to the rotating motor 11 via the inverter 12, can stop the upper rotary body by the control operation of the controller 19 without activating the parking brake 15 when an erroneous emergency stop operation is performed. Even if the stopping by the control operation is failed, the timer 21 activates the parking brake 15 when the set period of time has elapsed after the emergency stop operation is performed to thereby enable the rotation to be forcibly stopped. Thus, this device is capable of preventing wasteful activation of the parking brake 15 caused by an erroneous operation, while keeping the fundamental rule of stopping a rotation of the upper rotary body when the emergency stop operation is applied to the emergency stop switch 20, to thereby reduce the activation frequency of the parking brake 15 during a rotation and thereby suppress the damage of the parking brake 15.

Besides, when the inverter 12 constituting the rotation control section has been fallen in the failure condition, that is, when the rotation has been disabled from being stopped by the control of the operation of the rotating motor 11, the controller 19 can bring the parking brake 15 into the braking operation as soon as the failure is detected, i.e., regardless of the elapse of the set period of time for the off-delay timer relay 21, to thereby perform immediate rotation stopping. In particular, this embodiment, where the failure detection section of the controller 19 judges whether the inverter 12 is in the failure condition based on the rotation speed of the rotating motor 11 which actually performs rotating, allows the reliability in the failure judgement to be enhanced.

Next will be explained second and third embodiments only on the differences between these embodiments and the first embodiment.

Figure 3:
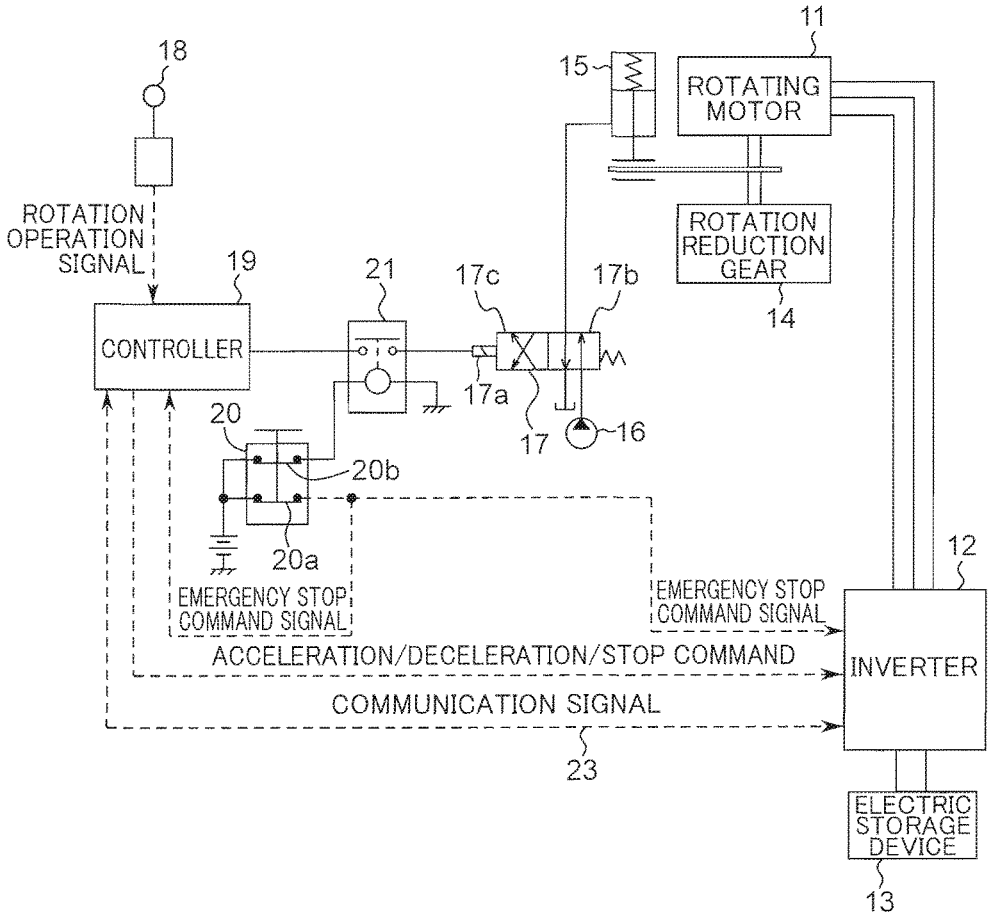
FIG. 3 is a system configuration diagram showing a rotation drive apparatus according to a second embodiment of the present invention.

The second embodiment shown in FIG. 3 further includes a communication line 23 interposed between the controller 19 and the inverter 12 to allow signal communication between the controller 19 and the inverter 12 through the communication line 23. The controller 19 includes a failure judgement section which judges that the inverter 12 is in the failure condition provided that there is a communication failure such as stopping of the signal communication through the communication line 23, the failure judgement section constituting a failure detection section in cooperation with the communication line 23. The controller 19 further includes an emergency stop section which brings the parking brake 15 into the braking operation when the failure detection section detects the failure.

This second embodiment allows the failure of the inverter 12 to be detected by the simple configuration only additionally including the communication line 23, thus realizing a low configuration cost.

Figure 4:
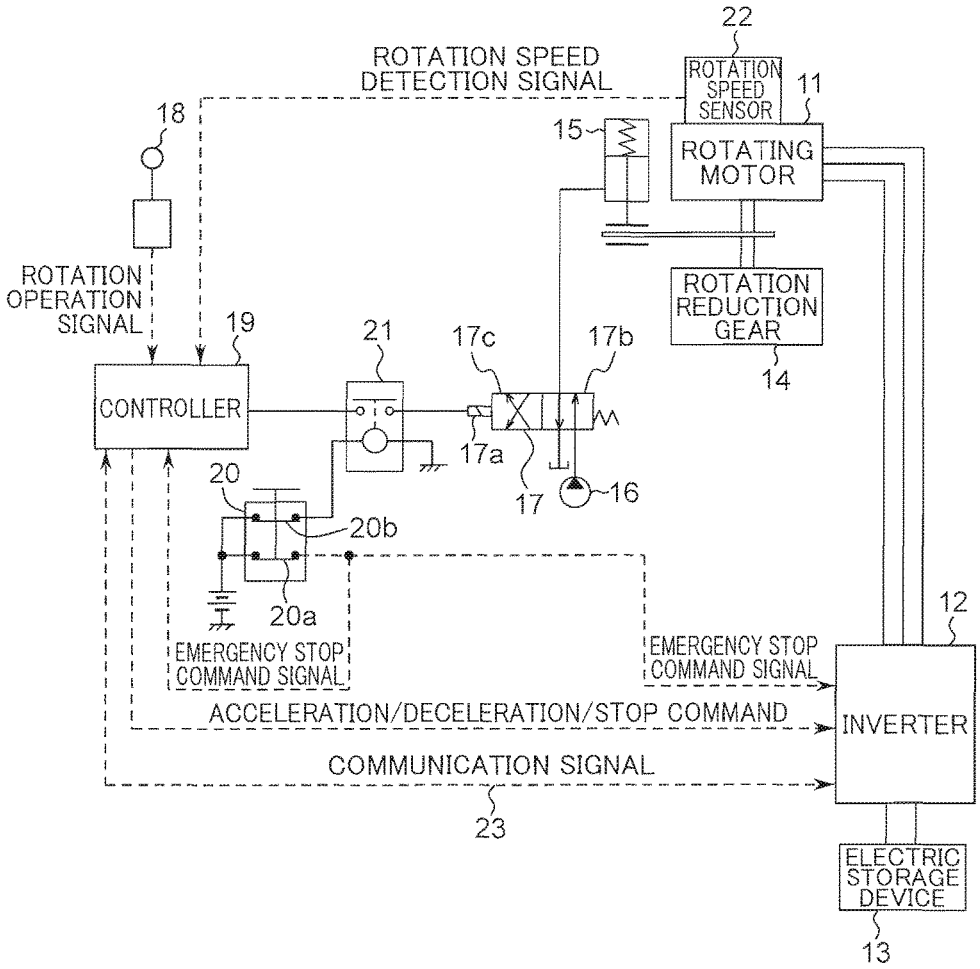
FIG. 4 is a system configuration diagram showing a rotation drive apparatus according to a third embodiment of the present invention.

The third embodiment shown in FIG. 4 includes both the rotation speed sensor 22 which is the rotation speed detection device and the communication line 23. The controller 19 includes a failure judgement section, which judges whether the inverter 12 is in the failure condition based on both the rotation speed of the rotating motor 11 detected by the rotation speed sensor 22 and the communication condition in the communication line 23. Such double failure detection allows more appropriate and immediate rotation stopping to be made.

As described above, according to the present invention is provided a rotation drive apparatus for rotating an upper rotary body of a construction machine, the rotation drive apparatus being capable of eliminating, while keeping a fundamental rule of stopping a rotation of the upper rotary body when an emergency stop operation is performed, wasteful stopping to thereby reduce the activation frequency of a parking brake for holding the stopped state. Provided is a rotation drive apparatus equipped in a construction machine including a lower travelling body and an upper rotary body rotatably mounted on the lower travelling body to rotate the upper rotary body, comprising: a rotating motor which is a rotation drive source for the upper rotary body; a rotation operation device including an operation member which receives an operation to instruct a rotational movement of the upper rotary body, the rotation operation device being configured to output a rotation operation signal according to the operation received by the operation member; a parking brake switchable between a brake activation state of applying a mechanical braking force to the upper rotary body and a brake release state of releasing the braking force; a brake valve operable to switch the parking brake between the brake activation state and the brake release state; an emergency stop switch which outputs an emergency stop command signal to execute an emergency stopping of the rotational movement when receiving an operation from an operator; a rotation control section which receives the rotation operation signal output by the rotation operation device and the emergency stop command signal output by the emergency stop switch, and controls the rotational movement of the upper rotary body based on the received signal; and a timer device which brings the parking brake into braking operation when a set period of time has elapsed after the emergency stop switch outputs the emergency stop command signal. The rotation control section performs inputting one of acceleration, deceleration, and stop commands to the rotating motor based on the rotation operation signal, inputting a brake activation command to the brake valve when the operation member of the rotation operation device is at a neutral position and the rotation of the upper rotary body is kept be stopped, inputting a brake release command to the brake valve when the operation member of the rotation operation device is at a position shifted from the neutral position, and inputting the stop command to stop the rotating motor to the rotating motor when receiving the emergency stop command signal.

In the apparatus, the controller is configured not to activate the parking brake in direct response to the emergency stop operation but to try to perform rotation stopping by inputting the rotation stop command to the rotating motor, which makes it possible to avoid activation of the parking brake when an erroneous emergency stop operation is performed. Even if the rotation cannot be stopped by the rotation stop command, the rotation can be forcibly stopped because the timer activates the parking brake when the set period of time has elapsed after the emergency stop operation. Thus, the apparatus is capable of reducing wasteful activation of the parking brake caused by an erroneous operation, while keeping the fundamental rule of stopping a rotation of the upper rotary body when the emergency stop operation is performed, to thereby reduce the frequency of stopping by the brake and suppress the damage of the parking brake.

It is preferred that: the rotation control section includes an inverter which controls an operation of the rotating motor and a controller which inputs an operation command to the brake valve and the inverter based on the rotation operation signal and inputs a command of stopping the rotating motor to the inverter based on the emergency stop command signal; the rotation drive apparatus further comprises an inverter failure detection section which detects a failure of the inverter; and the controller includes an emergency stop section which inputs, when the emergency stop command signal is input and the inverter failure detection section detects a failure of the inverter, the brake activation command to the brake valve to bring the parking brake into the braking action before the set period of time for activation of the timer has elapsed. The inverter failure detection section and the emergency stop section can bring the parking brake into the braking operation, regardless of the elapse of the set period of time for the timer, to stop a rotation as soon as the inverter constituting the rotation control section has been fallen in the failure condition to disable the rotation from being stopped by the control of the operation of the rotating motor.

For example, it is preferred that: the failure detection section includes a rotation speed detection device which detects a rotation speed of the rotating motor and a failure judgement section which judges whether the inverter is in a failure condition based on the rotation speed detected by the rotation speed detection device, the failure judgement section judging that the inverter is in the failure condition provided that the rotation speed of the rotating motor does not decrease after the emergency stop signal is input to the controller; and the emergency stop section inputs the brake activation command to the brake valve when the failure judgement section judges that the inverter is in the failure condition. The combination of the failure judgement section and the emergency stop section can make reliable judgement on whether the inverter is in the failure condition, based on an actual rotating operation.

Alternatively, it is also preferred that: the failure detection section includes a communication line interposed between the controller and the inverter to allow signal communication between the controller and the inverter through the communication line and a failure judgement section which judges that the inverter is in a failure condition provided that there is a communication failure in the communication line; and the emergency stop section inputs the brake activation command to the brake valve when the failure judgement section judges that the inverter is in the failure condition. The failure detection section can detect a failure of the inverter by a low cost facility of additionally including the communication line.

The failure judgement section, if configured to make both of a judgement based on the rotation speed of the rotating motor detected by the rotation speed detection device and a judgement based on a communication condition in the communication line, namely, to perform double failure detection, enables more appropriate and immediate rotation stopping to be performed.

The invention claimed is:

1. A rotation drive apparatus equipped in a construction machine including a lower travelling body and an upper rotary body rotatably mounted on the lower travelling body to rotate the upper rotary body, comprising:

a rotating motor which is a rotation drive source for the upper rotary body;

a rotation operation device including an operation member which receives an operation to instruct a rotational movement of the upper rotary body, the rotation operation device being configured to output a rotation operation signal according to the operation received by the operation member;

a parking brake switchable between a brake activation state of applying a mechanical braking force to the upper rotary body and a brake release state of releasing the braking force;

a brake valve operable to switch the parking brake between the brake activation state and the brake release state;

an emergency stop switch which outputs an emergency stop command signal to execute an emergency stopping of the rotational movement when receiving an operation from an operator;

a rotation control section which receives the rotation operation signal output by the rotation operation device and the emergency stop command signal output by the emergency stop switch, and controls the rotational movement of the upper rotary body based on the received signal; and a timer device which first brings the parking brake into braking operation when a set period of time has elapsed after the emergency stop switch outputs the emergency stop command signal, wherein the rotation control section performs inputting one of acceleration, deceleration, and stop commands to the rotating motor based on the rotation operation signal, inputting a brake activation command to the brake valve when the operation member of the rotation operation device is at a neutral position and the rotation of the upper rotary body is maintained stopped, inputting a brake release command to the brake valve when the operation member of the rotation operation device is at a position shifted from the neutral position, and inputting the stop command to stop the rotating motor to the rotating motor when receiving the emergency stop command signal, wherein:

the rotation control section includes an inverter which controls the operation of the rotating motor and a controller which inputs an operation command to the brake valve and the inverter based on the rotation operation signal and inputs a command to stop the rotating motor to the inverter based on the emergency stop command signal, the rotation drive apparatus further comprising an inverter failure detection section which detects a failure of the inverter, wherein the controller includes an emergency stop section which inputs, when the emergency stop command signal is input and the inverter failure detection section detects the failure of the inverter, the brake activation command to the brake valve to bring the parking brake into the braking operation before the set period of time for activation of the timer has elapsed.

2. The rotation drive apparatus for a construction machine according to claim 1, wherein: the inverter failure detection section includes a rotation speed detection device which detects a rotation speed of the rotating motor and a failure judgement section which judges whether the inverter is in a failure condition, based on the rotation speed detected by the rotation speed detection device, the failure judgement section judging that the inverter is in the failure condition provided that the rotation speed of the rotating motor does not decrease after the emergency stop signal is input to the controller; and the emergency stop section inputs the brake activation command to the brake valve when the failure judgement section judges that the inverter is in the failure condition.

3. The rotation drive apparatus for a construction machine according to claim 2, wherein:

the inverter failure detection section includes a communication line interposed between the controller and the inverter to allow signal communication between the controller and the inverter to be performed through the communication line and the failure judgement section which judges that the inverter is in the failure condition provided that there is a communication failure in the communication line; and the emergency stop section inputs the brake activation command to the brake valve when the failure judgement section judges that the inverter is in the failure condition.

4. The rotation drive apparatus for a construction machine according to claim 1, wherein:

the inverter failure detection section includes a communication line interposed between the controller and the inverter to allow signal communication between the controller and the inverter to be performed through the communication line and a failure judgement section which judges that the inverter is in a failure condition provided that there is a communication failure in the communication line; and the emergency stop section inputs the brake activation command to the brake valve when the failure judgement section judges that the inverter is in the failure condition.

* * * * *